US010760779B2

(12) United States Patent
Bowser et al.

(10) Patent No.: US 10,760,779 B2
(45) Date of Patent: Sep. 1, 2020

(54) LIGHTING FIXTURE WITH AUXILIARY BAY

(71) Applicant: IDEAL Industries Lighting LLC, Sycamore, IL (US)

(72) Inventors: Robert Bowser, Cary, NC (US); John Roberts, Durham, NC (US); Randy Bernard, Cary, NC (US)

(73) Assignee: IDEAL Industries Lighting LLC, Sycamore, IL (US)

( * ) Notice: Subject to any disclaimer, the term of this patent is extended or adjusted under 35 U.S.C. 154(b) by 0 days.

(21) Appl. No.: 15/957,991

(22) Filed: Apr. 20, 2018

(65) Prior Publication Data

US 2019/0323693 A1 Oct. 24, 2019

(51) Int. Cl.

| | |
|---|---|
| ***F21V 21/04*** | (2006.01) |
| ***F21V 23/00*** | (2015.01) |
| ***F21V 23/02*** | (2006.01) |
| ***F21V 23/06*** | (2006.01) |
| *F21Y 115/10* | (2016.01) |

(52) U.S. Cl.

CPC ..... *F21V 21/041* (2013.01); *F21V 23/002* (2013.01); *F21V 23/003* (2013.01); *F21V 23/02* (2013.01); *F21V 23/06* (2013.01); *F21Y 2115/10* (2016.08)

(58) Field of Classification Search

CPC .... F21V 21/041; F21V 21/042; F21V 23/002; F21V 23/003; F21S 8/026

USPC ..... 362/365

See application file for complete search history.

(56) References Cited

U.S. PATENT DOCUMENTS

| | | | | |
|---|---|---|---|---|
| 9,807,845 | B2 * | 10/2017 | Clark | F21S 8/033 |
| 9,943,042 | B2 * | 4/2018 | Thosteson | H05B 37/0272 |
| 10,006,619 | B1 * | 6/2018 | Niemiec | F21V 3/00 |
| 2007/0133193 | A1 * | 6/2007 | Kim | E04B 9/32 362/147 |
| 2014/0331489 | A1 * | 11/2014 | Ni | F21V 23/006 29/825 |
| 2016/0286619 | A1 * | 9/2016 | Roberts | H05B 33/0854 |

* cited by examiner

*Primary Examiner* — Evan P Dzierzynski
*Assistant Examiner* — Keith G. Delahoussaye
(74) *Attorney, Agent, or Firm* — Withrow & Terranova, P.L.L.C.

(57) ABSTRACT

A lighting fixture includes a fixture body, a lighting bay, a light source, and an auxiliary bay. The lighting bay is in a first portion of the fixture body. The light source is in the lighting bay, and is configured to provide light suitable for general illumination. The auxiliary bay is adjacent to the lighting bay in a second portion of the fixture body. The auxiliary bay includes a mounting surface suitable for mounting an auxiliary device in the auxiliary bay and an auxiliary bay frame surrounding the auxiliary bay, which supports and therefore allows for the installation of a removable auxiliary bay cover over the auxiliary bay. Providing the auxiliary bay in the fixture body allows auxiliary devices to be installed in a ceiling without any changes to the ceiling.

19 Claims, 9 Drawing Sheets

LIGHTING FIXTURE WITH AUXILIARY BAY

FIELD OF THE DISCLOSURE

The present disclosure is related to lighting fixtures, and in particular to lighting fixtures for installation into a drop ceiling that provides an extensible platform for the integration of other devices and allows the resources of the lighting fixture to be used to support additional building services and building accessories.

BACKGROUND

Drop ceilings are nearly ubiquitous in commercial spaces such as office buildings. As the technology infrastructure of many businesses continues to increase in complexity and breadth, these drop ceilings have become crowded with devices such as lighting fixtures, speakers, wireless networking access points, security cameras, emergency lighting, and the like. In some cases, the large number of devices results in an undesirable appearance of the ceiling. Often, devices need to be added to or removed from a drop ceiling as the technology infrastructure of a business changes. These changes may require permitting, evacuation, and other special accommodations such as tenting. Further, adding new devices may require significant expenditures to deliver power and a data connection to the devices. Accordingly, there is a need for improved ways for incorporating devices into the ceiling of commercial spaces.

SUMMARY

In one embodiment, a lighting fixture includes a fixture body, a lighting bay, a light source, and an auxiliary bay. The lighting bay is in a first portion of the fixture body. The light source is in the lighting bay, and is configured to provide light suitable for general illumination. The auxiliary bay is adjacent to the lighting bay in a second portion of the fixture body. The auxiliary bay includes a mounting surface suitable for mounting an auxiliary device in the auxiliary bay and an auxiliary bay frame surrounding the auxiliary bay, which supports and therefore allows for the installation of a removable auxiliary bay cover over the auxiliary bay. Providing the auxiliary bay in the fixture body allows auxiliary devices to be installed in a ceiling without any changes to the ceiling. When not in use, the auxiliary bay may be covered by the auxiliary bay cover such that the appearance of the ceiling is not disturbed.

In one embodiment, the auxiliary bay includes an auxiliary device connector, which provides power to the auxiliary device. In another embodiment, the auxiliary device connector provides both power and a data connection to the auxiliary device. By providing power and data to the auxiliary device, the auxiliary device may be installed without any changes to the ceiling.

In one embodiment, the lighting fixture further includes driver circuitry and a power source. The driver circuitry provides a drive signal to the light source, which controls one or more characteristics of the light provided from the light source. The power source provides power to the driver circuitry. In one embodiment, the power source also provides power to the auxiliary device via the auxiliary device connector. The power source may be a Power over Ethernet (PoE) switch, an alternating current (AC) power source, or an alternating current (AC) to direct current (DC) converter. In another embodiment, the driver circuitry provides power to the auxiliary device via the auxiliary device connector or through a standard AC receptacle.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

Figure 1:
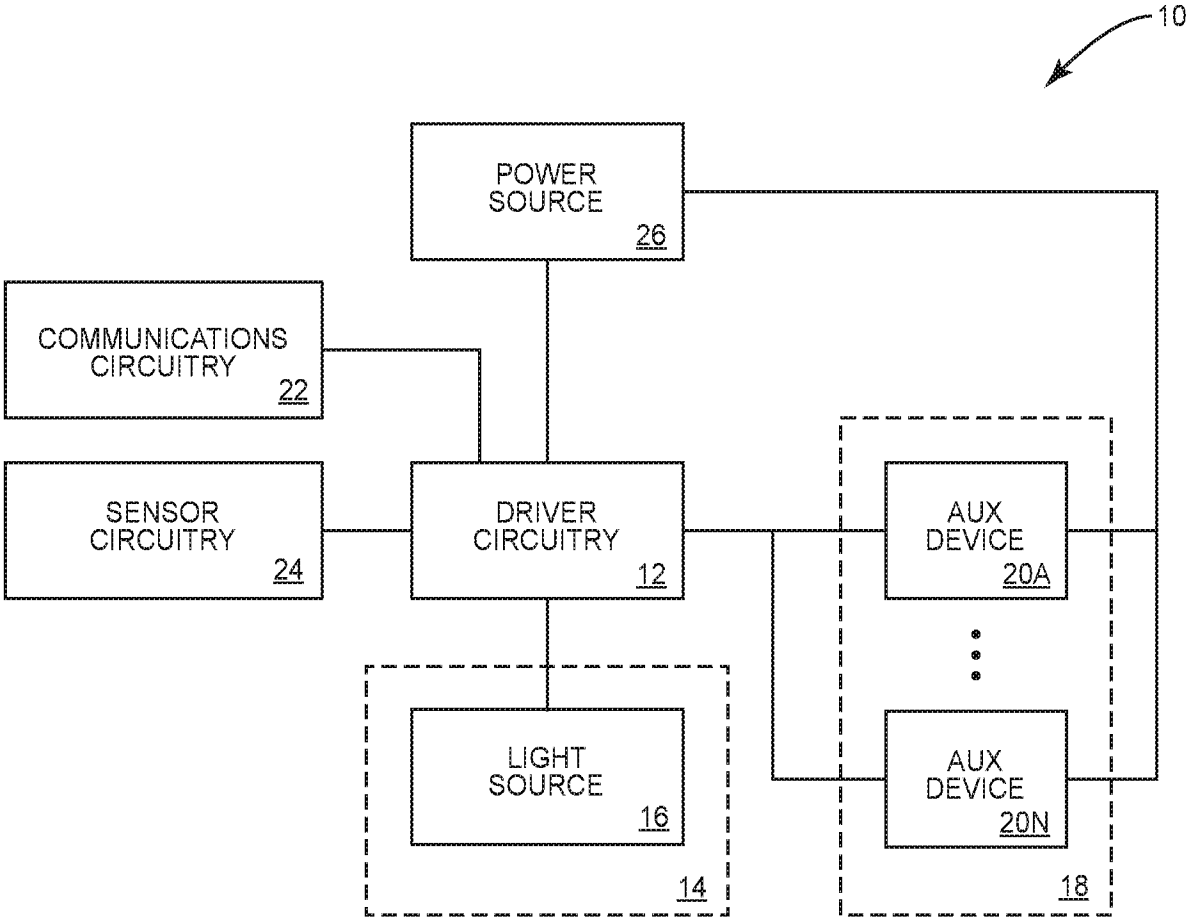
FIG. 1 is a functional schematic illustrating details of a lighting fixture according to one embodiment of the present disclosure.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

FIG. 1 shows a functional schematic of a lighting fixture 10 according to one embodiment of the present disclosure. The lighting fixture 10 includes driver circuitry 12, a lighting bay 14, a light source 16, an auxiliary bay 18, a number of auxiliary devices 20 (shown individually as 20A through 20N), communications circuitry 22, sensor circuitry 24, and a power source 26. The light source 16 is in the lighting bay 14. The auxiliary devices 20 are in the auxiliary bay 18. The light source 16, the communications circuitry 22, and the sensor circuitry 24 are coupled to the driver circuitry 12. The auxiliary devices 20 are optionally coupled to the driver circuitry 12. The driver circuitry 12 is coupled to the power source 26. The auxiliary devices 20 are optionally coupled to the power source 26.

In operation, the driver circuitry 12 acts as the primary controller of the lighting fixture 10. In this capacity, the driver circuitry 12 may communicate with one or more other devices via the communications circuitry 22, receive sensor data via the sensor circuitry 24, and control one or more light output characteristics (e.g., brightness, color, color temperature, color rendering index, or any other light output characteristic) of the light source 16. Further, the driver circuitry 12 may receive power from the power source 26 and provide conditioning thereto in order to power the light source 16, the auxiliary devices 20, the communications circuitry 22, and the sensor circuitry 24. In some embodiments, this may include performing power conversion or signal conditioning. For example, the power source 26 may be an alternating current (AC) to direct current (DC) converter, and the driver circuitry 12 may suitably condition a DC output signal from the power source 26 to provide a desired light output from the light source 16 as well as power the auxiliary devices 20, the communications circuitry 22, and the sensor circuitry 24. In another embodiment, the power source 26 may be an AC power source, and thus the driver circuitry 12 may perform AC-to-DC conversion and appropriate signal conditioning to accomplish the same task, or in the case that the auxiliary devices 20 are AC powered, the AC power from the power source 26 may be passed directly to the auxiliary devices 20, for example, via a standard AC outlet. In yet another embodiment, the power source 26 may be a Power over Ethernet (PoE) switch, and the driver circuitry 12 may thus suitably condition a PoE output signal from the power source 26 to accomplish the same task. The driver circuitry 12 may provide power to the auxiliary devices 20, or the auxiliary devices 20 may be powered directly from the power source 26. Further, the driver circuitry 12 may regulate the power provided to the auxiliary devices 20, either directly or through the power source 26 or other intermediary device.

In addition to powering the auxiliary devices 20 (in some embodiments), the communications circuitry 22, the sensor circuitry 24, and the driver circuitry 12 also communicate therewith. Such communication may be accomplished in any suitable manner, for example, via an Inter-Integrated Circuit ($I^2C$) bus, a serial bus, or any other suitable communications bus, wired or otherwise. The driver circuitry 12 may thus receive input from the auxiliary devices 20, the communications circuitry 22, and the sensor circuitry 24, which may be used to change one or more light output characteristics of the light source 16 or perform any other desired function. Further, the driver circuitry 12 may control the behavior of the auxiliary devices 20, the communications circuitry 22, and the sensor circuitry 24 to perform any number of desired functions. In one embodiment, the communications circuitry 22 may include Bluetooth communications circuitry such that the lighting fixture 10 is capable of communicating with Bluetooth devices, acting as a Bluetooth beacon, detecting nearby Bluetooth beacons, or all of the above.

In some embodiments, the driver circuitry 12 may act as a gateway to the auxiliary devices 20, providing a data connection to the auxiliary devices 20 so that they may communicate with other devices in a network to which the driver circuitry 12 is connected (via the communications circuitry 22). This may be accomplished by effectively sharing a communications interface in the communications circuitry 22 with one or more of the auxiliary devices 20 as desired. In other embodiments, a separate data connection is provided to one or more of the auxiliary devices 20 that does not run through the driver circuitry 12. Such embodiments may be used, for example, when the power source 26 is a PoE switch as discussed above. In still other embodiments, one or more of the auxiliary devices 20 communicates with one or more other devices via the driver circuitry 12 but still maintains a separate data connection that does not run through the driver circuitry 12 for other communications.

The light source 16 may include any suitable light output devices, but preferably includes a number of light emitting diodes (LEDs). In particular, the light source 16 may include a number of LEDs arranged in strings or otherwise such that one or more light output characteristics can be changed by adjusting a voltage across or current through one or more subsets of the LEDs.

The auxiliary devices 20 may be any type of devices. For example, the auxiliary devices 20 may include networking equipment (e.g., routers, switches, wireless access points), speakers, sensors, safety equipment (e.g., exit signs, emergency sirens, emergency lights), or any other devices that are normally installed in a ceiling. The auxiliary bay 18 provides a reserved space for such auxiliary devices 20, while the lighting fixture 10 provides power and data to these auxiliary devices 20 as necessary. Since the lighting fixture 10 is pre-installed in the ceiling, the cost for adding the auxiliary devices 20 to the infrastructure of the building in which the lighting fixture 10 is installed may be minuscule. In one embodiment, there is no difference between the lighting bay 14 and the auxiliary bay 18, and the light source 16 is provided as an auxiliary device 20 the same as any other type of auxiliary device 20. In such an embodiment, the lighting fixture 10 becomes a ceiling mounted dock in which any number of auxiliary devices 20, including a light source 16 may be provided.

FIGS. 2A through 2D show details of the exterior of the lighting fixture 10 according to one embodiment of the present disclosure. The lighting fixture 10 includes a fixture body 28, which is meant to be installed in a drop ceiling. The fixture body 28 includes an upper portion 30A, which, when the lighting fixture 10 is installed in a drop ceiling, resides above the drop ceiling (in a plenum of the drop ceiling), and a lower portion 30B, which, when the lighting fixture 10 is installed in the drop ceiling, resides below the drop ceiling (below the plenum of the drop ceiling). The upper portion 30A of the fixture body 28 includes an electronics housing 32 in which electronics such as the driver circuitry 12 and the communications circuitry 22 for the lighting fixture 10 are stored. The lower portion 30B of the fixture body 28 includes the lighting bay 14 located in a first portion of the fixture body 28, a first auxiliary bay 18A located adjacent to the lighting bay 14 in a second portion of the fixture body 28, and a second auxiliary bay 18B located adjacent to the lighting bay 14 in a third portion of the fixture body 28.

The lighting bay 14 includes a diffuser 34 and a sensor covering 36. The diffuser 34 is optional, but when provided, covers the light source 16 and may help to diffuse the light provided therefrom to provide a desirable light pattern. The sensor covering 36 may include one or more openings through which one or more sensors in the sensor circuitry 24 can monitor the environment surrounding the lighting fixture 10. For example, the sensor covering 36 may include appropriate openings and covers for a passive infrared (PIR) occupancy sensor, an ambient light sensor, a camera, a microphone, or any other sensors. Measurements from the sensors in the sensor circuitry 24 may be used by the driver circuitry 12 to change one or more light output characteristics from the light source 16 as discussed above.

Each one of the first auxiliary bay 18A and the second auxiliary bay 18B may be surrounded by an auxiliary bay frame 38. The auxiliary bay frame 38 is configured to support a first auxiliary bay cover 40A over the first auxiliary bay 18A and a second auxiliary bay cover 40B over the second auxiliary bay 18B. In one embodiment, the auxiliary bay frame 38 does this by providing a lip surrounding each one of the first auxiliary bay 18A and the second auxiliary bay 18B, the details of which are discussed below. The first auxiliary bay cover 40A and the second auxiliary bay cover 40B may rest in this lip to conceal the first auxiliary bay 18A and the second auxiliary bay 18B, respectively, from view when installed. However, such an embodiment is only one example; the auxiliary bay frame 38 may support the first auxiliary bay cover 40A and the second auxiliary bay cover 40B in any suitable manner without departing from the principles described herein. For example, the first auxiliary bay cover 40A and the second auxiliary bay cover 40B may be installed via a friction fit in some embodiments. The first auxiliary bay cover 40A and the second auxiliary bay cover 40B may be made to resemble the tiles in a drop ceiling such that when in place they are virtually indistinguishable from a drop ceiling and thus do not interrupt the appearance of the ceiling. While not shown, the first auxiliary bay cover 40A and the second auxiliary bay cover 40B may include one or more openings. These openings may be sized to accommodate, for example, one or more antennas such that these antennas may be passed through in order to provide improved wireless signal strength, one or more acoustic covers (e.g., speaker grills) in order to improve sound transmission characteristics for one or more sound transmission devices therein, and one or more indicators (e.g., lights) to provide an individual looking at the indicator with information. In other embodiments, the entire first auxiliary bay cover 40A and second auxiliary bay cover 40B may be replaced with different materials, shapes, and the like to accommodate a particular configuration of auxiliary devices 20 provided in the first auxiliary bay 18A and the second auxiliary bay 18B, respectively. For example, when one or more sound transmission devices are provided in the first auxiliary bay 18A, the first auxiliary bay cover 40A may comprise a material with desirable sound transmission characteristics. As another example, when one or more wireless communications devices are provided in the second auxiliary bay 18B, the second auxiliary bay cover 40B may comprise a material with desirable wireless signal transmission characteristics or may include openings therein to pass antennas from the wireless communications devices through such that the second auxiliary bay 40B does not degrade the wireless performance of the wireless communications devices.

Figure 2A:
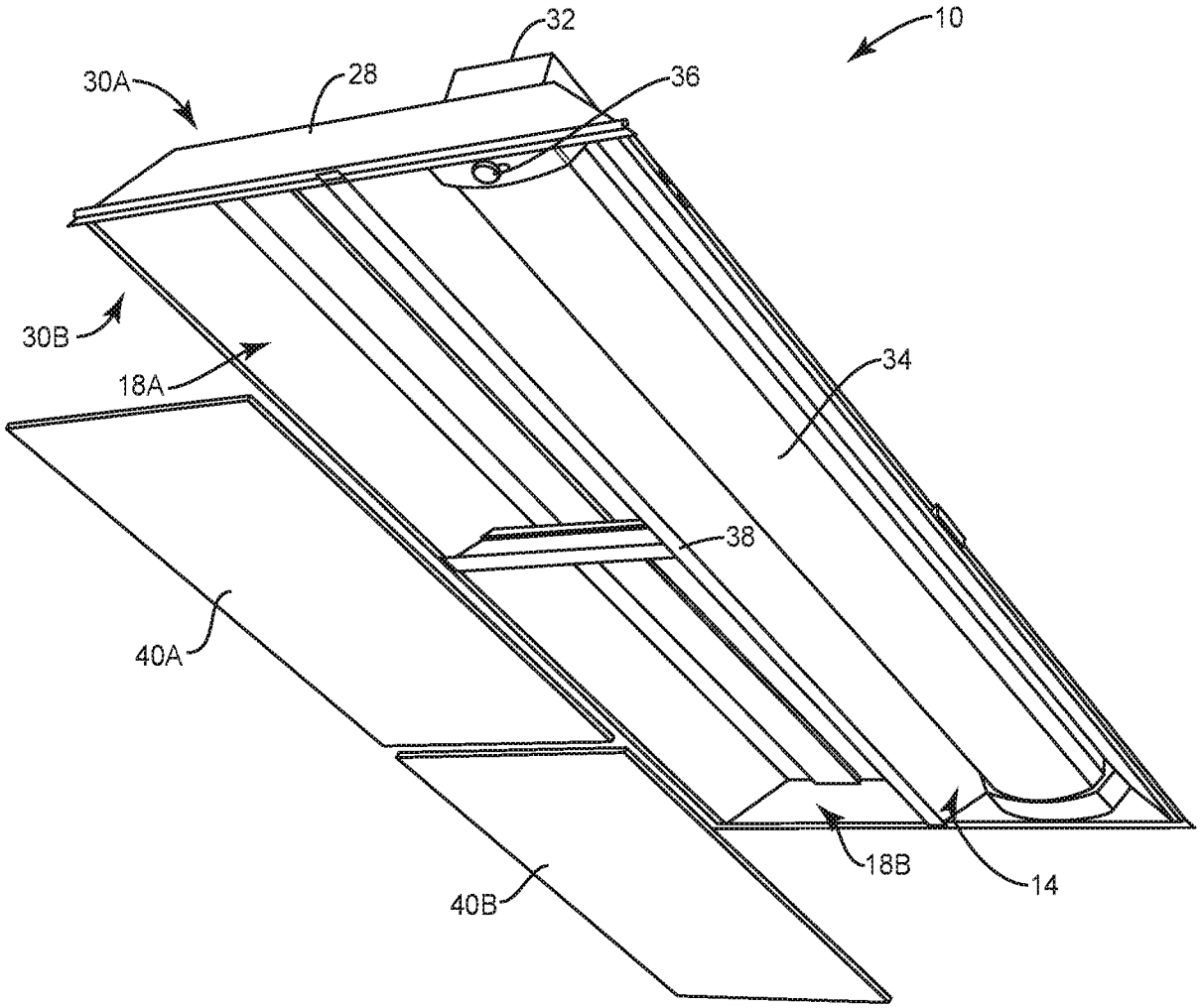
FIGS. 2A through 2D illustrate the exterior of a lighting fixture according to one embodiment of the present disclosure.
Figure 2B:
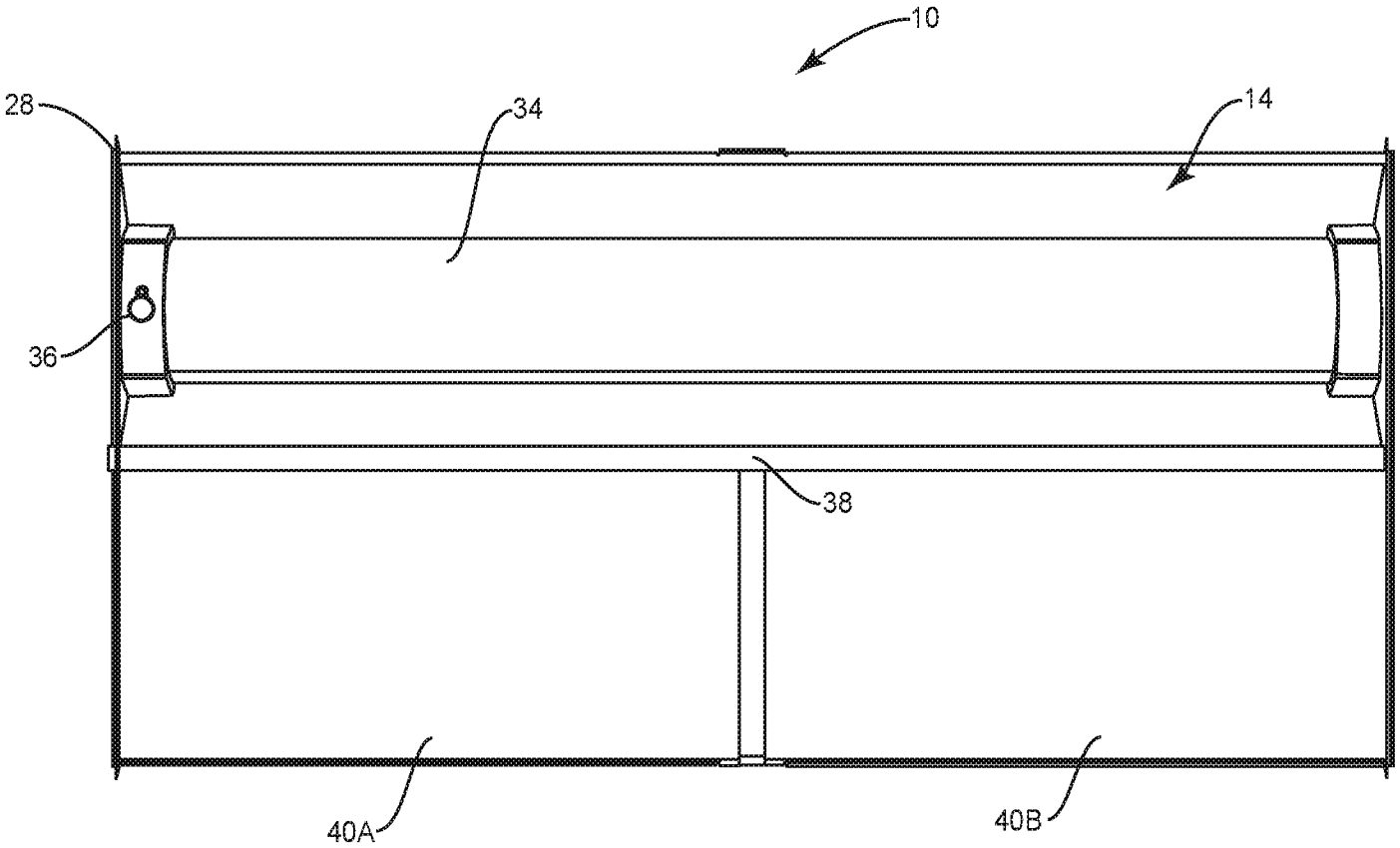
Figure 2C:
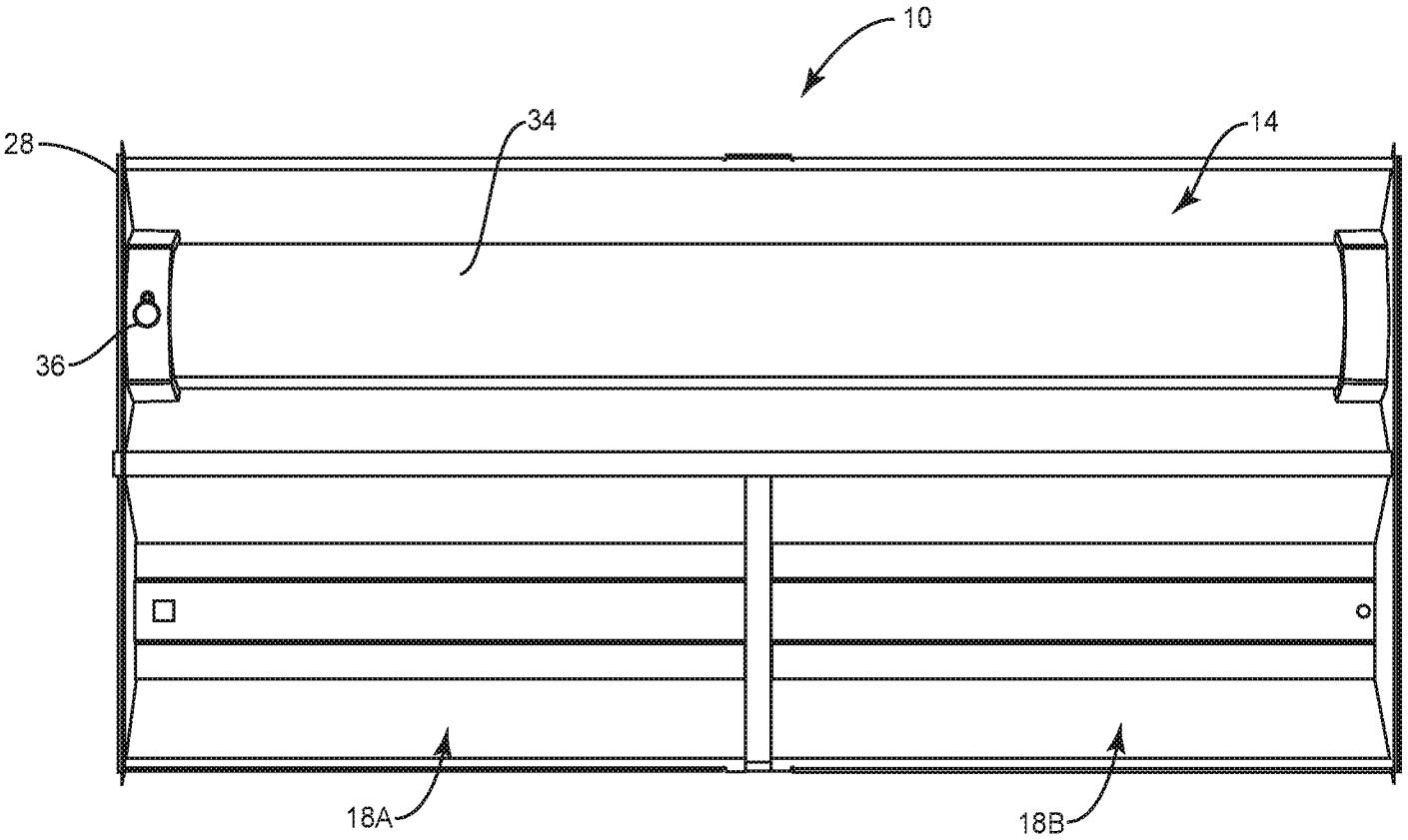
Figure 2D:
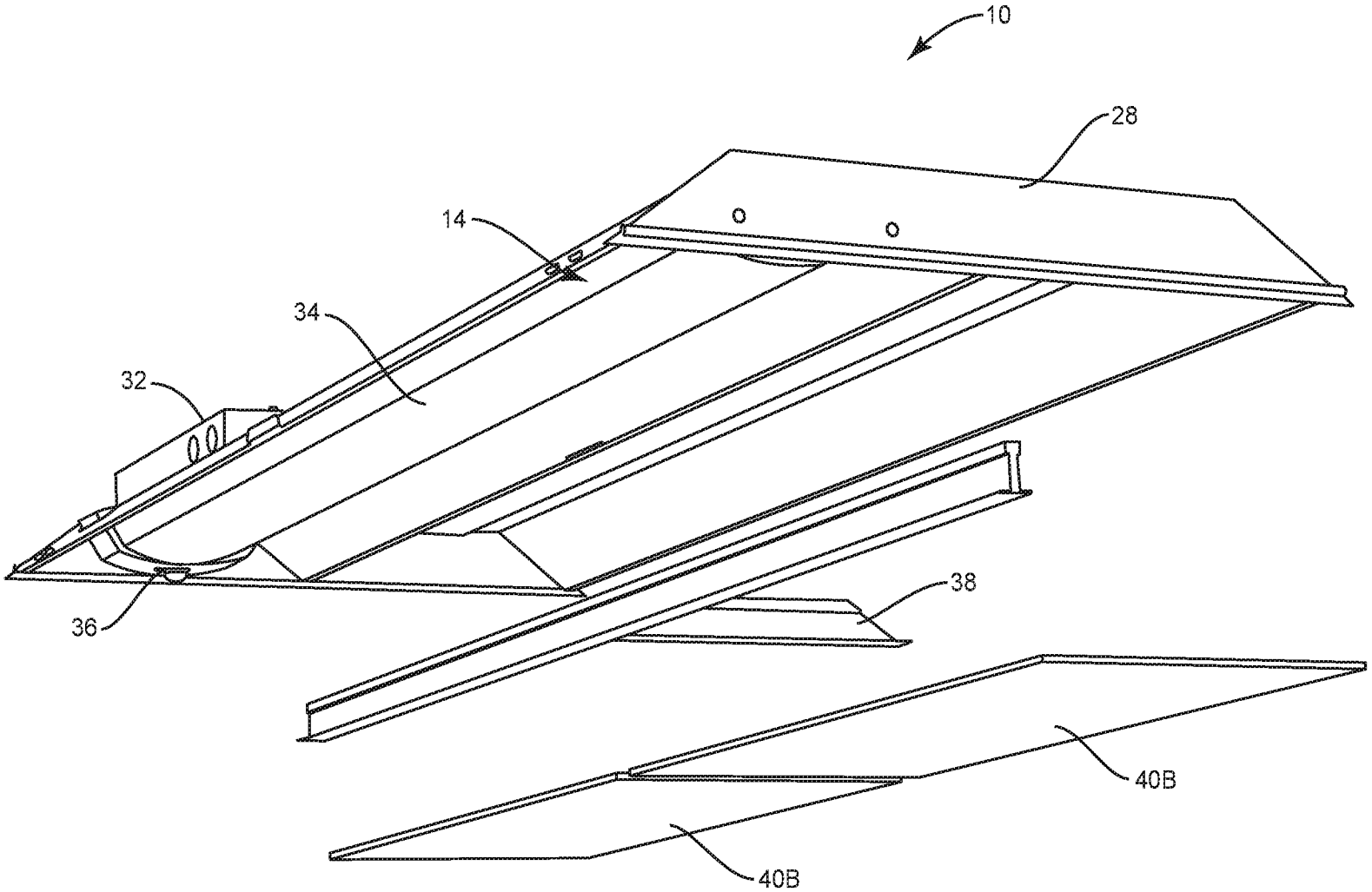

FIG. 2A shows the lighting fixture 10 with the first auxiliary bay cover 40A and the second auxiliary bay cover 40B removed therefrom to expose the first auxiliary bay 18A and the second auxiliary bay 18B. FIG. 2B shows the lighting fixture 10 as viewed from below a ceiling in which the lighting fixture 10 is installed with the first auxiliary bay cover 40A and the second auxiliary bay cover 40B covering the first auxiliary bay 18A and the second auxiliary bay 18B, respectively. FIG. 2C shows the lighting fixture 10 from the same angle as FIG. 2B, but with the first auxiliary bay cover 40A and the second auxiliary bay cover 40B removed therefrom to expose the first auxiliary bay 18A and the second auxiliary bay 18B, respectively. FIG. 2D shows the lighting fixture 10 with a portion of the auxiliary bay frame 38, the first auxiliary bay cover 40A, and the second auxiliary bay cover 40B removed therefrom to illustrate details of the auxiliary bay frame 38.

Notably, while two auxiliary bays 18 are shown in the lighting fixture 10, any number of auxiliary bays 18 may be included without departing from the principles of the present disclosure. That is, the lighting fixture 10 may include one auxiliary bay 18, three auxiliary bays 18, or any other number of auxiliary bays 18, each of which may be suited for providing one or more auxiliary devices 20 therein. Further as discussed above, the lighting bay 14 may also be an auxiliary bay in some devices such that it is identical to the other auxiliary bays 18. In these embodiments, the light source 16 is installed in the lighting bay 14 the same as any auxiliary device 20 is installed in the auxiliary bays 18.

Figure 3A:
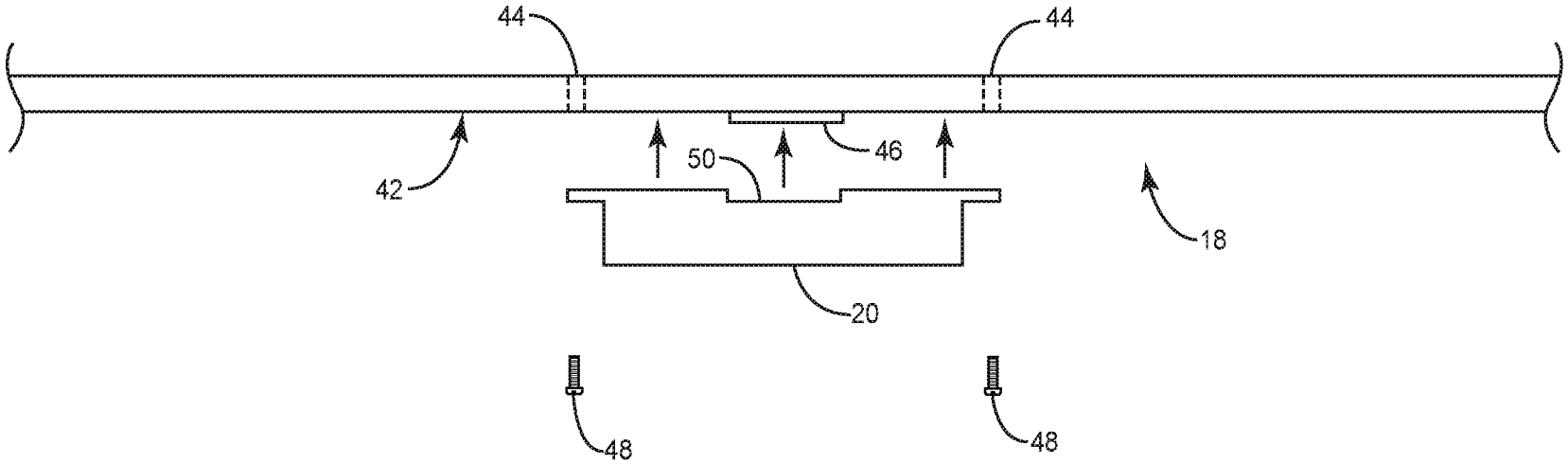
FIGS. 3A and 3B illustrate a cross-sectional view of an auxiliary bay for a lighting fixture according to one embodiment of the present disclosure.
Figure 3B:
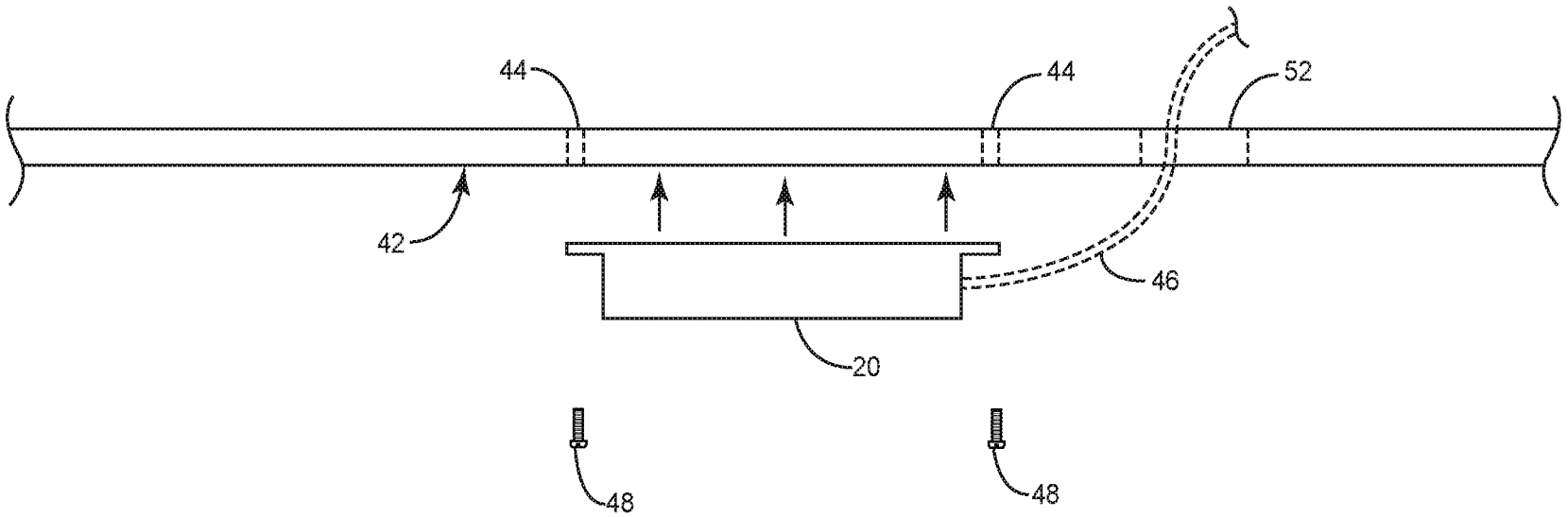

While FIG. 1 illustrates the functional relationship between the auxiliary devices 20 and the lighting fixture 10 and FIGS. 2A through 2D illustrate the space in which the auxiliary devices 20 may be provided in the lighting fixture 10, these drawings do not show how the auxiliary devices 20 are mounted and connected when provided in the lighting fixture 10. FIG. 3A thus shows a cross-sectional view of an auxiliary bay 18 according to one embodiment of the present disclosure. The auxiliary bay 18 includes a mounting surface 42 on which an auxiliary device 20 may be mounted, mounting holes 44 in the mounting surface 42, and an auxiliary device connector 46. The mounting holes 44 may be arranged in a standardized format (e.g., Video Electronics Standards Association mount) and configured to accept zero or more fasteners 48 in order to secure one or more auxiliary devices 20 to the mounting surface 42 of the auxiliary bay 18. Notably, the mounting holes 44 may be replaced by any suitable mounting mechanisms including but not limited to snap-lock mechanisms, magnetic interfaces, adhesive interfaces, hook-and-loop interfaces, or any other mechanical interface suitable for securing one or more auxiliary devices 20 within the auxiliary bay 18. In addition to the mounting holes 44, the auxiliary bay 18 may include any number of mechanisms in which to secure one or more auxiliary devices 20 therein in such a way to prevent tampering with and removal of the auxiliary devices 20. For example, the auxiliary bay may include a locking mechanism such as a Kensington key lock mechanism in order to prevent tampering with and removal of one or more auxiliary devices 20 within the auxiliary device bay 20. The auxiliary device connector 46 may be secured to the mounting surface 42 of the auxiliary bay 18 and positioned to mate with a complementary connector 50 on the auxiliary device 20 when the auxiliary device 20 is mounted in the auxiliary bay 18. In other embodiments, the auxiliary device connector 46 may be a cable that is routed through an auxiliary device connector opening 52 in the mounting surface 42 and plugged into the auxiliary device 20 as illustrated in FIG. 3B. As discussed above, the auxiliary device connector 46 may provide power, data, or both to the auxiliary device 20. Accordingly, an auxiliary device 20 may be easily installed in a ceiling by providing it in an auxiliary bay 18 of the lighting fixture 10 and connecting the auxiliary device connector 46 thereto. The auxiliary bay 18 may then be covered to maintain the appearance of the ceiling or left open if the auxiliary device 20 therein requires open air access to the surrounding environment. This foregoes the need for any permitting, evacuation, and other special accommodations such as tenting.

Figure 4A:
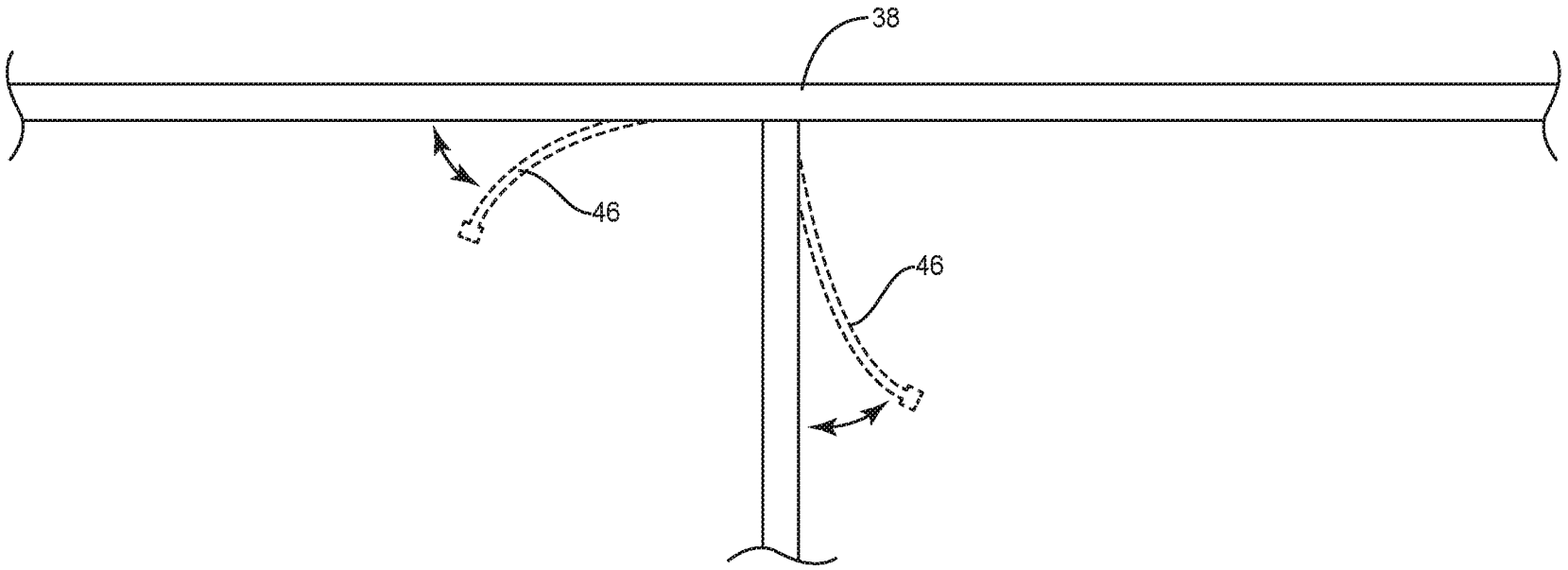
FIGS. 4A and 4B illustrate details of a lighting fixture according to one embodiment of the present disclosure.
Figure 4B:
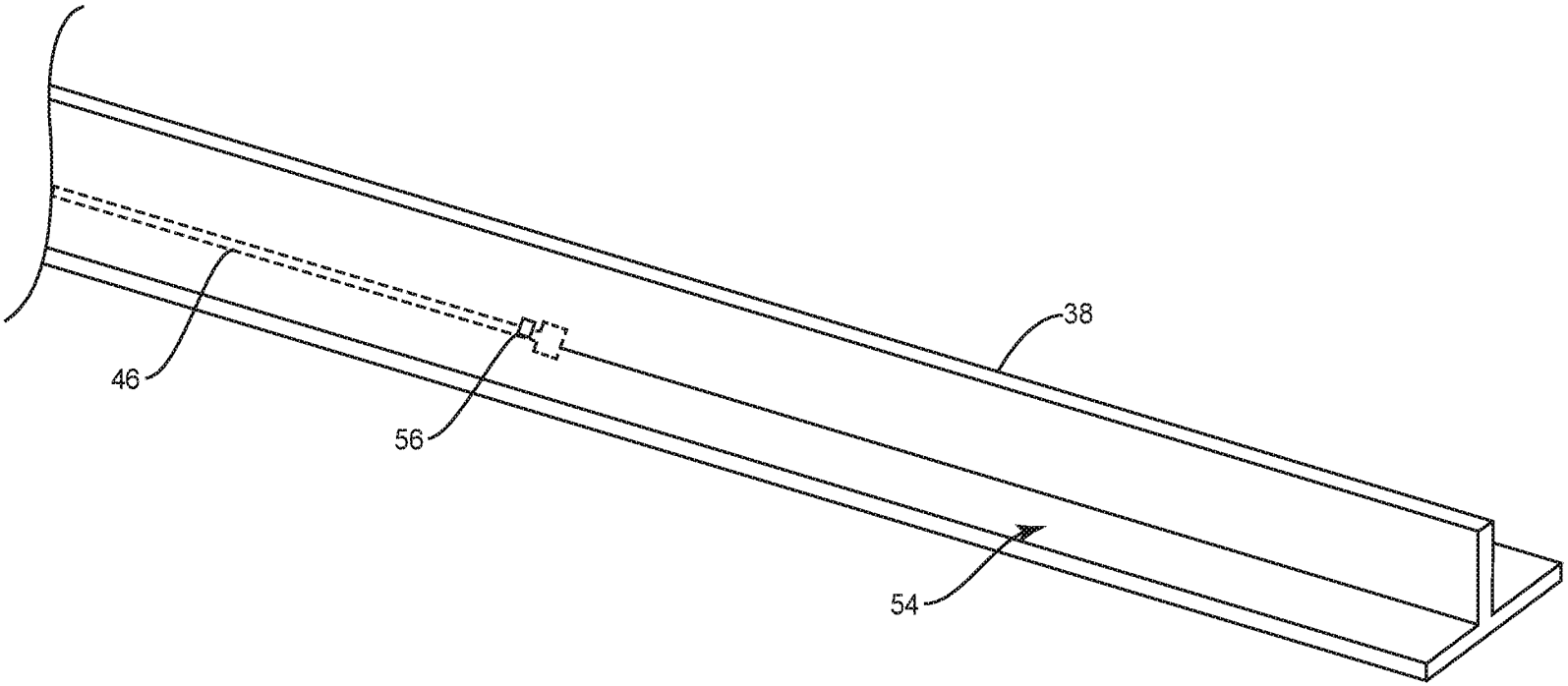

The auxiliary device connector 46 for each auxiliary bay 18 may be hidden in the auxiliary bay frame 38 when not used, as illustrated in FIG. 4A, which shows a bottom-up view of the auxiliary bay frame 38 as would be seen looking up at the lighting fixture 10 when installed in a ceiling. As shown, an auxiliary device connector 46 may rest in a lip provided by the auxiliary bay frame 38 and extended as necessary to connect to an auxiliary device 20. Each auxiliary bay 18 may include multiple auxiliary device connectors 46. FIG. 4B shows a detailed view of a part of the auxiliary bay frame 38, wherein an auxiliary device connector 46 is hidden in a lip 54 therein. A tab 56 or other securing mechanism such as a magnet attached to the auxiliary device connector 46 may hold the auxiliary device connector 46 in place when it is not being used. The lip 54 shown in FIG. 4B is the same one used to hold one of the auxiliary bay covers 40 in place in order to cover the auxiliary bay 18 as discussed above.

In some embodiments, the lighting fixture 10 may not include an auxiliary bay 18, but still include an auxiliary device connector 46. In such embodiments, the auxiliary device connector 46 may be hidden in an outer frame of the lighting fixture 10 as shown in FIGS. 4A and 4B, but extended to a neighboring portion of the ceiling where an auxiliary device 20 is installed in a traditional manner. In this way, the lighting fixture 10 may still provide power, data, or both to the auxiliary device 20 and thus significantly decrease cost and effort in installed said device.

Notably, the auxiliary device connector 46 may be any suitable type of connector. For example, the auxiliary device connector 46 may be a Universal Serial Bus (USB) connector of any type (A, B, C), an RJ45 connector (Ethernet, Power over Ethernet), a Digital Addressable Lighting Interface (DALI) connector, a standard AC power outlet, or any other type of connector. As discussed above, the auxiliary device connector 46 may provide power, data, or both power and data to the auxiliary devices 20 to which it is connected. Accordingly, a large variety of devices may be provided in the auxiliary bays 18. One advantage of providing a device in the auxiliary bay 18 is that the device does not need to be plenum rated because the auxiliary bay 18 is below and isolated from the plenum space above the ceiling. This may enable the use of an even larger variety of devices in a ceiling mounted configuration than would otherwise be permitted in typical building codes.

Those skilled in the art will recognize improvements and modifications to the preferred embodiments of the present disclosure. All such improvements and modifications are considered within the scope of the concepts disclosed herein and the claims that follow.

What is claimed is:

1. A lighting fixture for installation in a drop ceiling, the lighting fixture comprising:

a fixture body;

a lighting bay in a first portion of the fixture body;

a light source in the lighting bay, the light source configured to provide light suitable for general illumination;

an electronics housing on an upper surface of the fixture body and extending in a direction opposite of light emission from the light source, wherein the electronics housing is configured to store at least driver circuitry configured to provide a drive signal to the light source; and an auxiliary bay adjacent to the lighting bay in a second portion of the fixture body, the auxiliary bay comprising:

a mounting surface configured to receive an auxiliary device in the auxiliary bay; and an auxiliary bay frame surrounding the auxiliary bay and separating the auxiliary bay from the lighting bay, wherein the auxiliary bay is configured to support a removable auxiliary bay cover that is configured to be placed in the auxiliary bay frame to cover the auxiliary bay and the auxiliary device in the auxiliary bay, wherein the auxiliary bay is located below a plenum of the drop ceiling.

2. The lighting fixture of claim 1 wherein the light source comprises one or more light emitting diodes (LEDs).

3. The lighting fixture of claim 1 wherein the auxiliary bay further comprises an auxiliary device connector, which is coupled to a power source to provide power to the auxiliary device.

4. The lighting fixture of claim 3 wherein the auxiliary device connector is further configured to provide a data connection to the auxiliary device such that the auxiliary device is configured to communicate with one or more other devices.

5. The lighting fixture of claim 4 wherein the auxiliary device connector is an RJ45 connector.

6. The lighting fixture of claim 1 wherein the fixture body is configured to be mounted in the drop ceiling such that an upper surface of the fixture body is concealed above the drop ceiling and a lower surface of the fixture body is exposed below the drop ceiling.

7. The lighting fixture of claim 6 wherein the lighting bay and the auxiliary bay comprise the lower surface of the fixture body.

8. The lighting fixture of claim 1 further comprising:

driver circuitry configured to provide a drive signal to the light source such that the drive signal controls one or more characteristics of the light provided from the light source; and a power source configured to provide power to the driver circuitry.

9. The lighting fixture of claim 8 wherein the power source is a Power over Ethernet (PoE) switch.

10. The lighting fixture of claim 8 wherein the power source is an alternating current (AC) to direct current (DC) converter.

11. The lighting fixture of claim 8 wherein the power source is an alternating current (AC) power source.

12. The lighting fixture of claim 8 wherein the power source is further configured to provide power to the auxiliary device.

13. The lighting fixture of claim 12 wherein the power source is a Power over Ethernet (PoE) switch.

14. The lighting fixture of claim 12 wherein the power source is an alternating current (AC) to direct current (DC) converter.

15. The lighting fixture of claim 12 wherein the auxiliary bay further comprises an auxiliary device connector configured to provide power from the power source to the auxiliary device.

16. The lighting fixture of claim 15 wherein the auxiliary device connector is further configured to provide a data connection to the auxiliary device such that the auxiliary device is configured to communicate with one or more other devices.

17. The lighting fixture of claim 16 wherein:

the driver circuitry is further configured to communicate with the one or more other devices; and the data connection to the auxiliary device is provided via the driver circuitry.

18. The lighting fixture of claim 3 wherein the auxiliary device connector comprises a cable routed in the auxiliary bay frame and configured to be concealed from view when not in use.

19. The lighting fixture of claim 18 wherein the auxiliary bay frame includes a securing mechanism configured to secure the auxiliary connector to the auxiliary bay frame when not in use.

* * * * *